US005193235A

United States Patent [19]

Kircher

[11] Patent Number: 5,193,235

[45] Date of Patent: Mar. 16, 1993

[54] FLAT LYING SLEEPING BAG

[76] Inventor: Kathy Kircher, 2061 Combre Ct., Carlsbad, Calif. 92009

[21] Appl. No.: 889,991

[22] Filed: May 29, 1992

[51] Int. Cl.[5] ..... A47G 9/08

[52] U.S. Cl. ..... 5/413; 5/494; 5/922

[58] Field of Search ..... 5/413, 494, 417–420, 5/629, 422, 423, 496, 498, 500, 502; 2/69.5

[56] References Cited

U.S. PATENT DOCUMENTS

| | | | |
|---|---|---|---|
| 1,102,200 | 6/1914 | Miller | 5/413 |
| 1,637,088 | 7/1927 | Padolsky | 2/69.5 |
| 1,748,501 | 2/1930 | Stevens | 5/413 |
| 2,151,462 | 3/1939 | Bulpit et al. | 5/413 |
| 2,789,292 | 4/1957 | Budinquest | 5/494 |
| 2,967,306 | 1/1961 | Fabanich | 2/69.5 |
| 3,175,231 | 3/1965 | Magario et al. | 5/413 |
| 3,774,249 | 11/1973 | Ybarra et al. | 5/413 |
| 4,079,472 | 3/1978 | Maguire | 5/413 |
| 4,197,601 | 4/1980 | Maguire | 5/419 |
| 4,339,835 | 7/1982 | Jaffe et al. | 5/413 |
| 4,507,805 | 4/1985 | Calutoiu | 5/413 |
| 4,513,461 | 4/1985 | Tardivel | 5/413 |
| 4,575,876 | 3/1986 | Weaver | 5/413 |
| 4,601,076 | 7/1986 | Knobloch | 5/413 |
| 4,653,131 | 3/1987 | Diehl | 5/494 |
| 5,014,376 | 5/1991 | Doran et al. | 5/494 |

*Primary Examiner*—Alexander Grosz
*Attorney, Agent, or Firm*—John J. Murphey

[57] ABSTRACT

A flat lying sleeping bag including, in combination, a full body length flat bottom layer having a head end, bounded by a first transverse end edge, a foot end, bounded by a second transverse end edge, and a torso section lying therebetween wherein all the ends and sections are bounded by spaced apart first and second longitudinal side edges and including a plurality of individual disconnectable connectors mounted in spaced apart arrangement along the lower half of the side edges and along the second transverse end edge, and at least one shorter upper layer having a lower body portion defined by a transverse bottom end edge, for registration with the bottom layer second transverse end edge, and longitudinal first and second side edges spaced slightly further apart than the bottom layer side edges, and an upper body portion defined by a transverse top end edge terminating substantially below the bottom layer first transverse end edge and spaced apart second side wings that extend mutually outward substantially beyond the bottom layer side edges and are terminated at mutually spaced apart longitudinal side edges, wherein the upper layer has formed therethrough a like plurality of apertures along the lower half of the side edges and along the transverse bottom end edge for receiving the individual disconnectors therethrough to form a sleeping chamber between the layers with sufficient vertical room to loosely embrace the body while the bottom layer remains flat.

7 Claims, 2 Drawing Sheets

FLAT LYING SLEEPING BAG

BACKGROUND OF THE INVENTION

1. Field of the Invention

This invention pertains to the field of sports equipment. More particularly, it pertains to camping equipment and to a novel sleeping bag that has qualities simulating a bed.

2. Description of the Prior Art

Virtually everyone has slept in a sleeping bag at one time or another. Sleeping bags are not like beds. Beds remain flat through the night; sleeping bags do not. The conventional sleeping bag is crafted from two layers of the same size and shape. They are either zippered or sewn together down the sides and across the foot end. Thus, while one may throw off a cover if too warm in a bed, one can usually not throw off the upper layer of a sleeping bag. While one may adjust the covers in a bed to remain comfortable throughout the night, the sleeping bag user can only remain totally in the bag without air flow therethrough and swelter throughout the night, or unzip the top layer and freeze until morning.

In addition, because both layers of the conventional sleeping bag are the same size and are attached about the sides and bottom, the chamber formed between them causes both layers to become curved. The bottom layer does not remain flat, like a bed mattress, and the user is made to sleep in an area substantially narrower than the area provided by a bed mattress. This significant confinement to a long, narrow silhouette and the lack of air for circulation in or through the bag causes discomfort. The sleeping chamber thus formed is so confining that it prohibits to a great extent a person from rolling over as they would in their bed. The sleeping bag user is thus confined to one position, prone, supine or on their side. Such a restrained position often produces cramps, charlie horses, and stiff necks. While some diehard campers can overlook these drawbacks many cannot resulting in fewer people partaking of overnight camping than would do so if the sleeping bags were made more like a bed.

Sleeping bags do not have a pillow. This often makes their use so much different from a bed and pillow that one may not achieve a deep enough sleep resulting in a loss of enjoyment of the next day's activities. While a pillow may be used, the confining nature of the sleeping bag allows the pillow to move out from under the user's head This usually wakes up the user who searches for the pillow before getting back to sleep, thus interrupting the night's sleep.

Finally, most sleeping bags are just that, bags, without the ability to be disassembled for washing in a standard home-size washing machine. Even those bags that have zippered connections between the layer usually are not capable of easy cleaning because the zipper may nick or scratch the porcelain finish on the washing machine. Thus, sleeping bags are not washed as often as bedding and retain more musty odors for a longer time thereby making the use of the bag a somewhat offensive experience.

SUMMARY OF THE INVENTION

This invention yields a sleeping bag that has many of the attributes of a bed thereby allowing the user to experience the joy of outdoor activities and yet make their sleeping experience akin to sleeping in their favorite bed. The sleeping bag is constructed to yield a body chamber that does not require displacement of the bottom layer so that it can remain fully flat on the ground or mattress over which it is laid. The sleeping chamber is large enough to allow shifting of one's body from one position to another. The layers are loosely joined together thus allowing movement of air through the sleeping chamber such that the user remains free of heavy perspiration throughout the night. A pillow pouch is provided in the sleeping bag for those who wish to use a pillow. The pouch insures that the pillow remains with the user all night resulting in a more restful sleep.

The invention comprises a full body length flat bottom layer with a pouch in the head section to hold the pillow. One or more upper layers are provided having two sets of side edges, a first set in the foot and leg area that is slightly wider than the bottom layer to form a chamber for the feet and legs. The second set of side edges are in the torso area and ar substantially wider than the bottom layer to create a larger body chamber. The layers are attached only around the lower half and these attachments are made using spaced-apart short straps received in grommeted apertures so that air may enter the chambers between the straps to provide circulation therethrough. Other attachment means may include laces, such as shoe laces, tie-wraps, and the like. The chambers being formed mostly in the upper layer mean that the bottom layer will remain flat similar to a bed mattress. Such a configuration simulates conventional bedding so well that the normal non-camper quickly becomes the serious camper. Post-camping cleanup procedures are greatly enhanced by being able to place the individual layers in a conventional washing machine without fear of damaging the home washing machine.

Accordingly, the main object of this invention is a unique sleeping bag configuration that eliminates many of the problems and disadvantages existing in the prior art. Other objects include a sleeping bag whose bottom layer remains flat throughout use similar to the conventional bed; a bag that creates sufficient user space over the flat bottom layer to allow one to move and change sleeping positions throughout the night; a bag that allows removal of or addition of layers to prevent overwarming of the user or dangerous cooling throughout the nighttime; a bag that allows more air circulation through the sleeping chamber than allowed by conventional bags of the prior art; a sleeping bag that can retain a pillow within its confines so as to allow the user to enjoy a full night's sleep; and, a sleeping bag that can be easily disassembled so that the individual layers are amenable of being washed in a conventional washing machine.

These and other objects of the invention will become more apparent when reading the description of the preferred embodiment along with the drawings that are appended hereto. The protection sought by the inventor may be gleaned from a fair reading of the claims that conclude this specification.

DESCRIPTION OF THE PREFERRED EMBODIMENT

Figures 1, 2, 3:
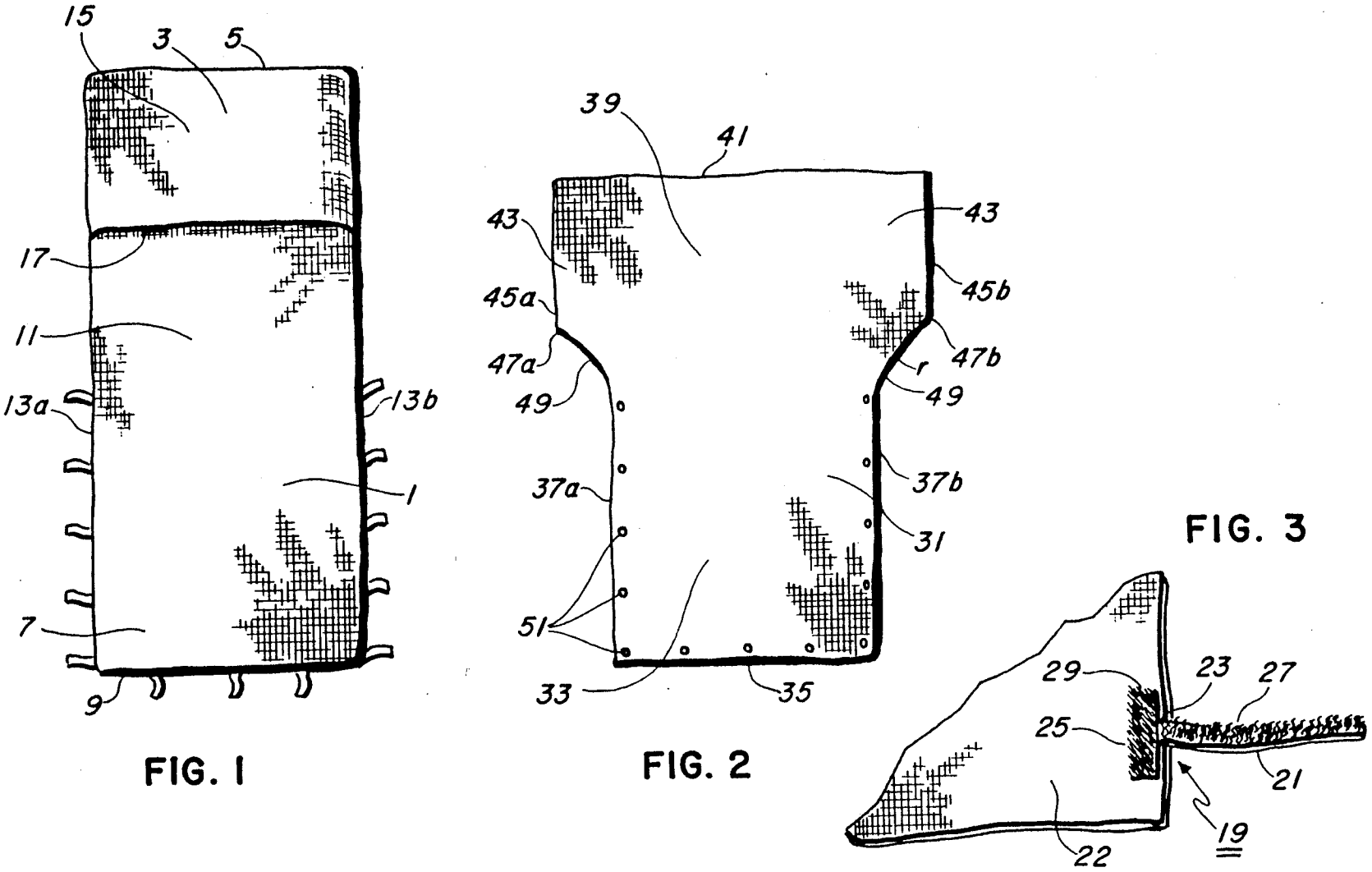
FIG. 1 is a plan view of the bottom layer of the preferred embodiment of this invention.
FIG. 2 is a plan view of an upper layer for placement over the bottom layer shown in FIG. 1.
FIG. 3 is an illustrative view of the preferred means to interconnect the layers shown in FIG. 1 and FIG. 2.

Turning now to the drawings wherein like elements are identified with like numerals throughout the six figures, FIG. 1 shows the bottom layer 1 of this invention, lying flat on a supporting surface such as the ground or the floor of a tent. Layer 1 is shown to have a head end 3, bounded by a first transverse end edge 5, a foot end 7, set spaced apart from head end 3, bounded by a second transverse end edge 9, and a torso section 11 situated therebetween. All three sections are further bounded by a pair of mutually spaced apart first and second longitudinal side edges 13*a* and 13*b*, respectively. Head end 3, foot end 7 and torso section 11 are all made with the same width. A pillow pouch 15 is formed in head end 3. As shown in FIG. 1, it is preferred that the pouch entry way 17 be located inboard from first transverse end edge 5 to keep the pillow from moving out of the pouch and away from the sleeping bag. Also, the interior entry way to pouch 15 permits the user to keep medicine and other personal items therein, away from the prying eyes of others.

A plurality of individual loop-type disconnectable connector means 19 is mounted in spaced apart arrangement along the lower half of side edges 13*a* and 13*b* and across second transverse end edge 9. As shown in FIG. 3, one embodiment of connector means 19 comprises a strip 21 of pressure sensitive, resilient, deformable self-adhering material connected at one end 23 to the bottom or underneath surface 22 of bottom layer 1 by a short strap 25 also sewn or otherwise mounted to bottom surface 22. An example of self-adhering material is a strip of flexible material containing a plurality of loop elements 27 on strip 21 and a plurality of hook elements 29 on strap 25. Loop elements 27 and hook elements 29 are resilient and deformable and when pressed together become removeably entangled. They can be released from entangled engagement by positively pulling hook elements 29 away from loop elements 27 or vice versa. The loop and hook fabric elements 27 and 29 are available under the trademark "Velcro", more specific details of which may be had from U.S. Pat. No. 2,717,437 entitled VELVET TYPE FABRIC AND METHOD OF PRODUCING SAME issued Sep. 13, 1955 to George de Mestral and U.S. Pat. No. 3,114,951 entitled DEVICE FOR JOINING TWO FLEXIBLE ELEMENTS issued Dec. 24, 1963 to George de Mestral. The material is hereinafter referred to as "Velcro" loop material and "Velcro" hook material, a product of American Velcro, Inc. These strip/strap combinations are attached to layer 1 in spaced apart fashion, for example every 8 inches or so. Such a positioning allows for outside air to enter the body chamber as will hereinafter be more fully explained. Other examples of loop-type connector means 19 are laces, such as shoe laces, tie-wraps, and the like.

A shorter, upper layer 31 is provided and, as shown in FIG. 2, comprises a lower body portion 33, that is defined by a transverse bottom end edge 35 which, when layer 31 is superimposed over bottom layer 1, will register with bottom layer second transverse end edge 9 and is further defined by first and second longitudinal side edges 37*a* and 37*b* spaced slightly further apart, e.g. 2 inches, than longitudinal side edges 13*a* and 13*b*, an upper body portion 39 defined by a transverse top end edge 41 that terminates below (i.e. 6–8 inches) bottom layer first transverse end edge 5, and above pouch entry way 17. Upper body portion 39 is further defined by a pair of side wings 43 extending substantially mutually outward (i.e. 10–12 inches) beyond longitudinal side edges 13*a* and 13*b* to terminate at mutually spaced apart longitudinal side edges 45*a* and 45*b*. The lower terminal corners 47*a* and 47*b* of side edges 45*a* and 45*b* are joined to lower body portion side edges 37*a* and 37*b* through a transitional edge 49. It is preferred that edge 49 be curved and even more preferred that the curve be set at a constant radius "r" as shown.

Figure 4:
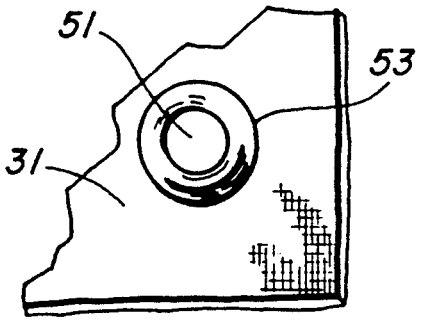
FIG. 4 is an illustrative view of the preferred embodiment of the aperture with which the connection means is used as shown in FIG. 3.
Figure 5:
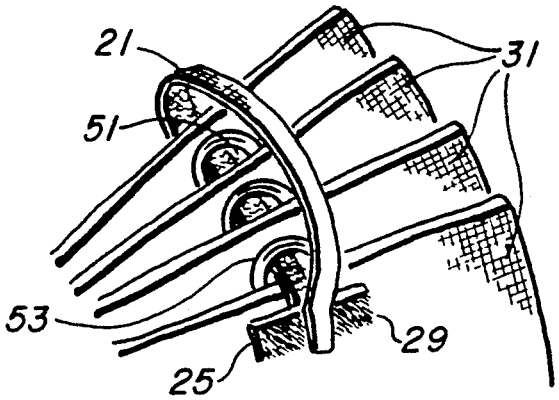
FIG. 5 is an illustrative view of one means of interconnecting the layers using the strap of FIG. 3 and the aperture of FIG. 4.
Figure 6:
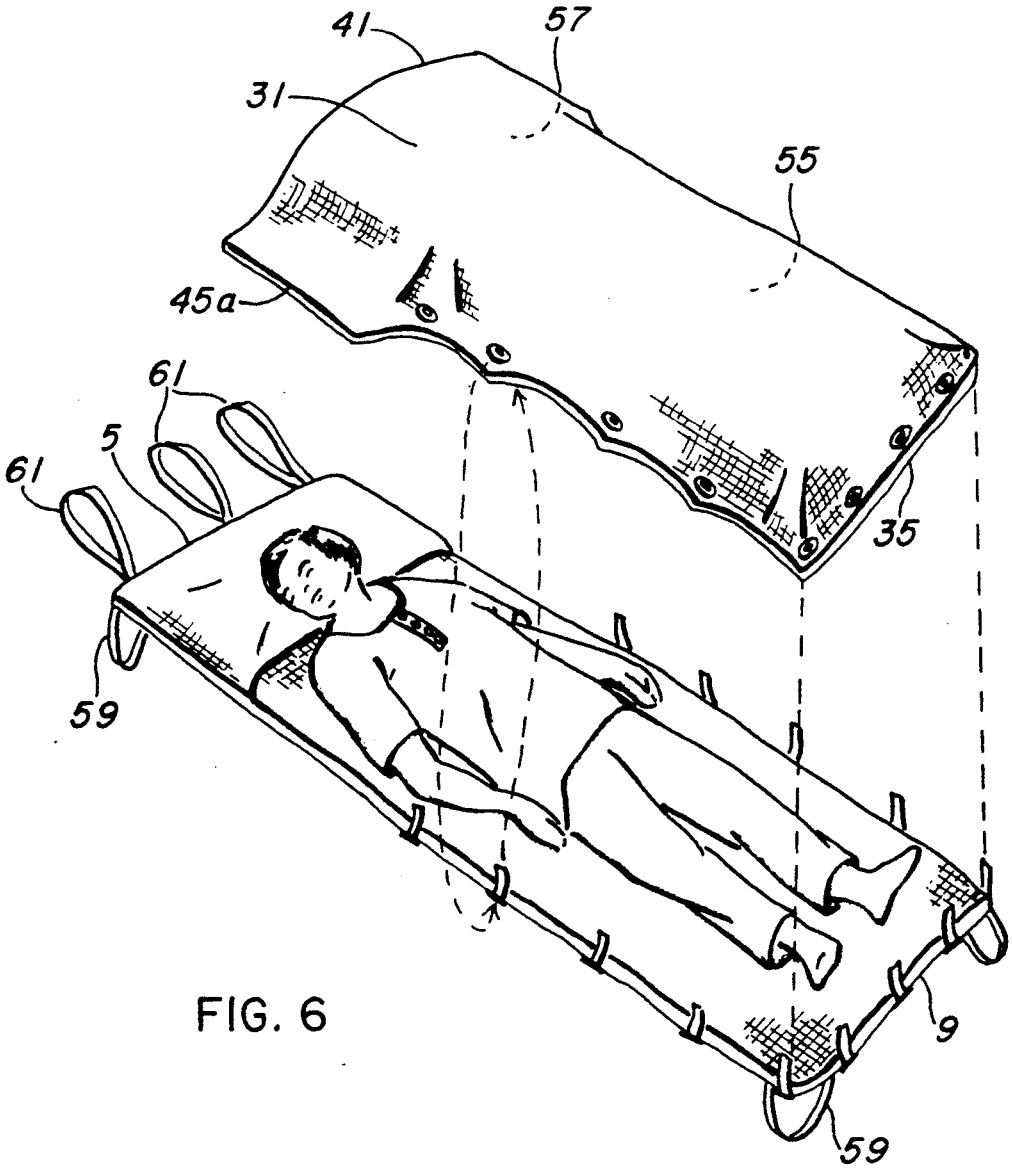
FIG. 6 is an illustrative view of the layers as they are preferred to be assembled.

A plurality of apertures 51, preferably of the same number and spacing as are strips 21, are formed in upper layer 31 along bottom edge 35 and first and second longitudinal side edges 37*a* and 37*b* a short distance in from the edge such as one-half inch or so. As shown in FIG. 4, it is preferred to surround apertures 51 with a metal or plastic grommet 53 to provide additional support thereto. As shown in FIGS. 5 and 6, upper layer 31 is attached to bottom layer 1 by passing strips 21 through apertures 51 and looping them back on strap 25 to entangle loop elements 27 and hook elements 29. When using laces, such as shoe laces or short lengths of string, etc., they are merely looped through apertures 51 and tied.

The extra width of upper layer 31 in lower body portion 33 creates a first chamber 55 therebetween for the legs and feet of the user above flat bottom layer 1. As seen in FIG. 6, upper body portion 39 of upper layer 31 provides a second larger chamber 57 above torso section 11 allowing significant movement of the user without disturbing flat layer 1. Also, side wings 43 allow the user to stretch out his or her arms to the side similar to that allowed in a conventional bed. The spaces between strips 21 allow for currents of air to enter first chamber 55 to provide cooling therein, if desired.

As shown in FIG. 6, the sleeping bag may be anchored or secured to a bed mattress or other support surface by straps 59 positioned diagonally across each corner of bottom layer 1. Such straps are preferably made of elastic tape for stretching over the corners of the mattress.

When not in use, the sleeping bag may be rolled up toward head end 3. For convenience in tying the bag into a roll, at least two loops 61 of strap or preferably elastic strap are attached to first transverse end edge 5 for looping about the roll.

More than one upper layer 31 may be used with the sleeping bag of this invention. As each layer is added, it is joined to bottom layer 1 by connector means 19 as shown in FIG. 5. An upper layer may be conveniently folded down over lower body portion 33 should the user become too warm. If that is not sufficient, the layer may be easily disconnected from means 19 and thrown further downward over foot end 7.

The material making up bottom layer 1 and upper layers 27 may be the same material now used in sleeping bags. To further simulate a conventional bed, first upper layer 27 could be made from percale or broadcloth while other upper layers could be made from ordinary blanket material. In either event, the layers are most conveniently disassembled and washable in an ordinary washing machine.

While the invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the way to achieve substantially the same result are within the scope of this invention.

What is claimed is:

1. A flat lying sleeping bag comprising, in combination:

a) a full body length flat bottom layer having a head end, bounded by a first transverse end edge, a foot end, bounded by a second transverse end edge, and a torso section lying therebetween wherein said ends and said section are bounded by spaced apart first and second longitudinal side edges;

b) at least one shorter upper layer having a lower body portion defined by a transverse bottom end edge, for registration with said bottom layer second transverse end edge, and longitudinal first and second side edges spaced slightly further apart than said bottom layer side edges, and an upper body portion defined by a transverse top end edge terminating below said bottom layer first transverse end edge and spaced apart side wings that extend mutually outward substantially beyond said bottom layer side edges and are terminated at mutually spaced apart longitudinal side edges;

c) a plurality of apertures formed in spaced-apart arrangement along the lower half of said upper layer side edges and along said transverse bottom edge;

d) a like plurality of loop-type strips of pressure-sensitive, resilient, deformable strips of material mounted in similar spaced-apart arrangement along the lower half of said bottom layer side edges and along said second transverse end edge for passing through said apertures; and e) said upper layer first longitudinal side edges being joined to said second longitudinal side edges by a transition edge.

2. The sleeping bag of claim 1 wherein said pressure sensitive, resilient, deformable strips are material Velcro (trademark).

3. The sleeping bag of claim 1 further including a pouch formed at said head end for removably containing a pillow.

4. The sleeping bag of claim 1 wherein said pouch includes an entry way located inboard from said first transverse end edge.

5. The sleeping bag of claim 1 further including an elastic strap fixed diagonally across to each corner of said bottom layer where said side edges intersect said transverse end edges for securing the corners of said bag to a bed mattress.

6. The sleeping bag of claim 1 further including at least two loops of strap attached to said bottom layer first transverse end edge for tying said bag in a roll.

7. The sleeping bag of claim 1 wherein the transition edge is a curved edge.

* * * * *